United States Patent [19]

Zimmerman

[11] Patent Number: 4,751,803

[45] **Date of Patent: * Jun. 21, 1988**

[54] PREFABRICATED CONCRETE WALL STRUCTURE

[75] Inventor: Melvin M. Zimmerman, Blue Ball, Pa.

[73] Assignee: Superior Walls of America, Ltd., East Earl, Pa.

[ * ] Notice: The portion of the term of this patent subsequent to Feb. 18, 2003 has been disclaimed.

[21] Appl. No.: 853,979

[22] Filed: Apr. 21, 1986

Related U.S. Application Data

[62] Division of Ser. No. 762,379, Aug. 5, 1985, Pat. No. 4,605,529.

[51] Int. Cl.[4] ..... E04B 1/18

[52] U.S. Cl. ..... 52/414; 52/309.12

[58] Field of Search ..... 52/414, 309.12, 309.11, 52/309.17, 293, 294, 311

[56] References Cited

U.S. PATENT DOCUMENTS

| | | | |
|---|---|---|---|
| 1,577,633 | 3/1926 | Collins | 52/414 X |
| 1,589,716 | 6/1926 | Peters | 52/414 |
| 3,503,165 | 3/1970 | Hardt | 52/293 X |
| 4,512,126 | 4/1985 | Walston | 52/309.12 |
| 4,570,398 | 2/1986 | Zimmerman | 52/309.12 |

*Primary Examiner*—J. Karl Bell

*Attorney, Agent, or Firm*—Martin Fruitman

[57] ABSTRACT

A new method of construction for concrete wall structures. Precast concrete studs with fasteners protruding from one edge are used to build the framework of the walls while oriented in a horizontal plane, rigid sheet insulation is attached to the outside of the concrete studs, and wire mesh is laid upon the sheet insulation. Concrete is then poured onto the insulation, the wire and the protruding fasteners to form a continuous waterproof outer surface. New top and bottom beams which are bonded to the concrete studs are formed at the same time as the outer concrete surface. After setting of the concrete, the wall is one integral concrete structure which may be transported to a construction site for erection.

9 Claims, 2 Drawing Sheets

PREFABRICATED CONCRETE WALL STRUCTURE

This is a division of application Ser. No. 726,379 filed Aug. 5, 1985 , now U.S. Pat. No. 4,605,529.

SUMMARY OF THE INVENTION

This invention deals generally with building construction and more specifically with the construction of concrete prefabricated walls.

The traditional methods of constructing building basements are well established. For commercial structures and for high volume residential developments with identical dimensions for each building, poured concrete is used. This involves the construction of forms, either wood or metal, in the exact shape of the vertical basement walls, and then pouring concrete into the forms. After the concrete hardens, the forms are removed and construction continues on the rest of the building.

The cost of forms limits this method to those structures where the height requires the strength of reinforced concrete or where the reuse of forms for many identical structures located in the same general area permits the sharing of the costs of form construction by many buildings.

The more common basement construction technique is the straight forward construction of the vertical walls by laying many courses of cinder block, one on top of the other. This method is virtually the only one in use for isolated building sites or small developments, and it is both time consuming and labor intensive. There has been no way of avoiding the fact that each cinder block must be individually placed and surrounded by mortar, and while whole walls above ground have been prefabricated of wood and sheathing, no such economy has been available for concrete walls. One need only watch a house being built to realize that the cinder block basement may take over a week to construct on a typical site, while the framing and exterior walls go up in just a day or so.

The present invention changes all that. The speed of construction of the wall of the preferred embodiment of the invention is no longer closely linked to the amount of manpower available, because the construction of a structure using the wall of the invention involves essentially only the installation of prefabricated walls.

The present invention permits the construction of a dry, strong, insulated basement with a limited work force in a relatively short time. Moreover, the labor cost is relatively unrelated to the size of the structure so that, for instance, a full height basement can be constructed with little additional cost and no additional time compared to a lower height structure.

The key to the structure is the use of concrete studs for vertical height and strength, the use of cast concrete on the exterior wall for sealing and waterproofing, and prefabricating the wall off-site for later installation.

The actual construction of such a wall involves the use of a unique precast concrete stud. Typically, this stud is two inches thick by six inches deep and eight feet long. It is cast in essentially rectangular cross section but can also contain a central narrower web to reduce weight and material cost. Steel reinforcing rods oriented along the length are cast into the studs to increase their strength and these rods extend out the ends. Several holes are formed in the central region to permit subsequent laying of electrical wires or water pipes through the studs within the walls that they form.

As the studs are cast, a wood strip is cast onto one long, narrow edge, the edge which will eventually be the support of the interior wall, and fasteners, such as metal nails, are cast into the opposite edge, the edge which will hold the exterior surface. The studs are thereby specifically designed to match their anticipated use in a specific building system.

The actual construction of the prefabricated wall is accomplished within an assembly jig which permits the wall to be manufactured in a horizontal position, so that conventional concrete delivery trucks can be used as a material source.

The assembly jig consists essentially of a set of channel-like elements and framing sides oriented in a horizontal plane. The channels are arranged as a pair of parallel members, about eight feet apart, and include precut notches on their inside flanges to support concrete studs which will be set perpendicular to the parallel pair. A typical spacing of the notches is two feet center to center.

The channel elements and frame sides are constructed so that all the peripheral edges of the grid configuration, that is, the edges forming an outside rectangle, are higher than all the other members by approximately four inches to form a frame around the entire structure. The channels which form the supports for the concrete studs include cavities of considerable volume which will eventually be filled with concrete to encase the ends of the concrete studs which are set into the notches on the channels. When the concrete studs are placed into the notches of the channels, a horizontal pattern of studs is formed. The studs are positioned so that their wood strips are down and unfinished concrete, with the metal fasteners protruding upward, is at the top of the grid. The length of the concrete studs is such that they extend into the cavities of the pair of parallel channels, but they are not attached to the channels.

After the stud configuration is in place, rigid sheet insulation is laid in place over the entire grid except for the channel cavities. The insulation sheets are impaled upon the fasteners protruding from the concrete studs. Then wire mesh is laid atop the insulation sheets and the fasteners on the cross studs protrude through the wires in the mesh. Therefore, the insulation is in a sandwich between the studs and the wire mesh. At this stage of construction the assembly jig appears from above to be a shallow pan whose edges are formed by the raised edges of the framing sides and whose bottom is sheet insulation with wire mesh laid over it and fasteners protruding through it. The studs are no longer visible except for their ends which protrude into the deep cavities formed at two parallel sides of the "pan" (the eventual top and bottom of the prefabricated wall).

Concrete is then poured into this pan and fills the entire volume up to the height of the peripheral edges of the framing sides. The concrete completely covers the insulation, the wire mesh, the protruding fasteners and fills the cavities holding the ends of the studs to form an essentially flat surface.

Standard concrete finishing techniques may be used to provide different finishes on the concrete, and other materials, such as brick veneer, can also be laid on top of the wet concrete to yield decorative effects.

Once hardened, the concrete not only forms an integral exterior surface, but also bonds together the several studs, because the fasteners protruding from the studs have all been encased in the concrete layer, and because the ends of the studs, and their protruding reinforcing rods, have been encased within newly formed top and bottom beams which result from the concrete being cast into the cavities of the pair of channels.

A strong waterproof wall is thus formed with much less labor and in a far shorter time than by conventional construction techniques of laying cinder block. Moreover, the integral exterior surface is far less susceptible to water seepage and the wood strip cast onto the interior surface of each concrete stud permits the finishing of the interior walls by standard interior wall techniques, with none of the problems of attaching finishing materials to concrete or cinder block.

DETAILED DESCRIPTION OF THE INVENTION

Figure 1:
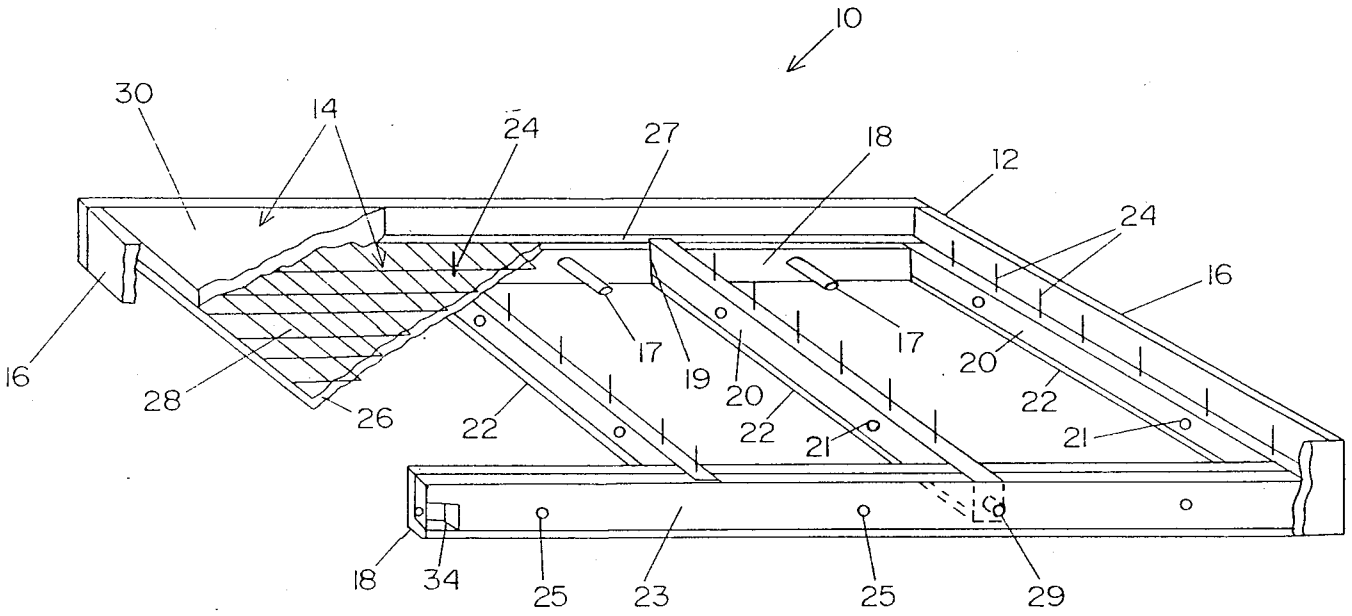
FIG. 1 is a cut-away perspective view of a assembled wall structure in an assembly jig.

The preferred embodiment of the invention is shown in FIG. 1, in a cut-away view, as it is just after the process of construction, in which assembly 10 contains both assembly jig 12 and assembled wall section 14. Both assembly jig 12 and wall section 14 are shown cut away so that the apparatus of the invention and the method of assembly can be better viewed.

Assembly jig 12 is formed essentially from framing member 16, which surrounds the periphery of the wall section, and support members 18 which locate and support concrete studs 20 which form the skeleton of wall section 14. Support members 18 have the basic shape of a channel or "u" which forms a cavity which is approximately the same depth as the height of concrete studs 20. Support members 18 are supported on a table or other planar surface (not shown) and can even be simply supported by the earth. Their orientation to each other is parallel, such that they determine a configuration similar to top and bottom beams of conventional walls, and they have notches 19 in their inside walls so that concrete studs 20 can be set into notches 19 to form a box-like skeleton with occasional cross studs between two parallel channels. Support members 18 may be interrelated to each other either by attaching each individual support member to the supporting planar surface or using independent support members (not shown) between them to, in effect, themselves form a total skeletal assembly.

Assembly jig 12 performs the task of locating the several preformed concrete studs 20 into the proper configuration to furnish the skeletal frame upon which wall section 14 will be assembled.

Studs 20 are long members of essentially rectangular cross section which contain wood strips 22 on one edge and protruding fasteners 24 on the other edge, both of which are attached to the stud as it is being manufactured. Studs 20 also include several holes 21 through their thickness as various locations along their length. These holes serve to permit electrical cable and plumbing pipes to pass through them after the wall section is installed as a part of a building.

To construct wall section 14, concrete studs 20 are placed within notches 19 of support members 18 to form a typical rectangular grid configuration with several studs 20 oriented perpendicular to support members 18 within which concrete will be poured. Studs 20 are placed within support members 18 so that wood strips 22 are downward and essentially inaccessible, while protruding fasteners 24 of all the studs point upward and the ends of studs 20 protrude into support members 18. Concrete studs 20 also contain reinforcing rods 29 which are arranged to protrude from the ends of concrete studs 20 and into the cavity of support members 18. When all the studs are in place, only one is adjacent to frame member 16, and the internal studs of the skeletal framework extend fully between the support members 18.

Construction of wall section 14 then continues with the production of three successive layers of material onto the stud framework from which multiple fasteners 24 protrude. The first layer installed is rigid insulation sheet 26. Insulation sheet 26 is laid across the entire framework except for the tops of support members 18 to form a complete surface, but is shown for clarity in FIG. 1 as only a small section. Insulation sheet 26 is impaled upon fasteners 24, and, after it is installed fasteners 24 protrude through it.

The next layer installed is wire mesh 28 for reinforcement of the subsequent concrete layer. Wire mesh 28 is laid atop the entire surface formed by insulation sheet 26, but after installation of wire mesh 28, fasteners 24 should still protrude through or within the wires of wire mesh 28, that is, the structure of wire mesh 28 should leave substantial protruding lengths of fasteners 24 exposed.

The final layer added is concrete 30. Conventional wet concrete is poured into the tray-like container formed by framing members 16 on the edges and insulation sheet 26 as a bottom surface, with wire mesh 28 already in the "tray". Concrete is also poured into and fills the cavities of support members 18, thus forming two new concrete beams 23 and 27, encasing the ends of and interlocking with concrete studs 20. When concrete 30 hardens it not only covers wire mesh 28 and insulation sheet 26, but it also encapsulates fasteners 24 and the ends and reinforcing rods 29 of concrete studs 20, thereby forming a unitized structure which bonds together the entire wall section. The encapsulation of fasteners 24, which were previously cast into the concrete of each concrete stud 20, and the ends of studs 20, holds each concrete stud 20 firmly attached to unitized wall section 14.

All that is left to do after concrete 30 hardens is to lift wall section 14 out of assembly jig 12. This can be accomplished by jacking one edge of wall section 14 out of assembly jig 12 and then attaching lifting aids, such as eyebolts, through holes 25 in concrete beams 23 and 27. These holes are formed in beams 23 and 27 by the use of cores 17. Before the concrete is poured cores 17 are set into predrilled holes in support members 18 and after the concrete sets cores 17 are tapped out to leave holes 25.

Figure 2:
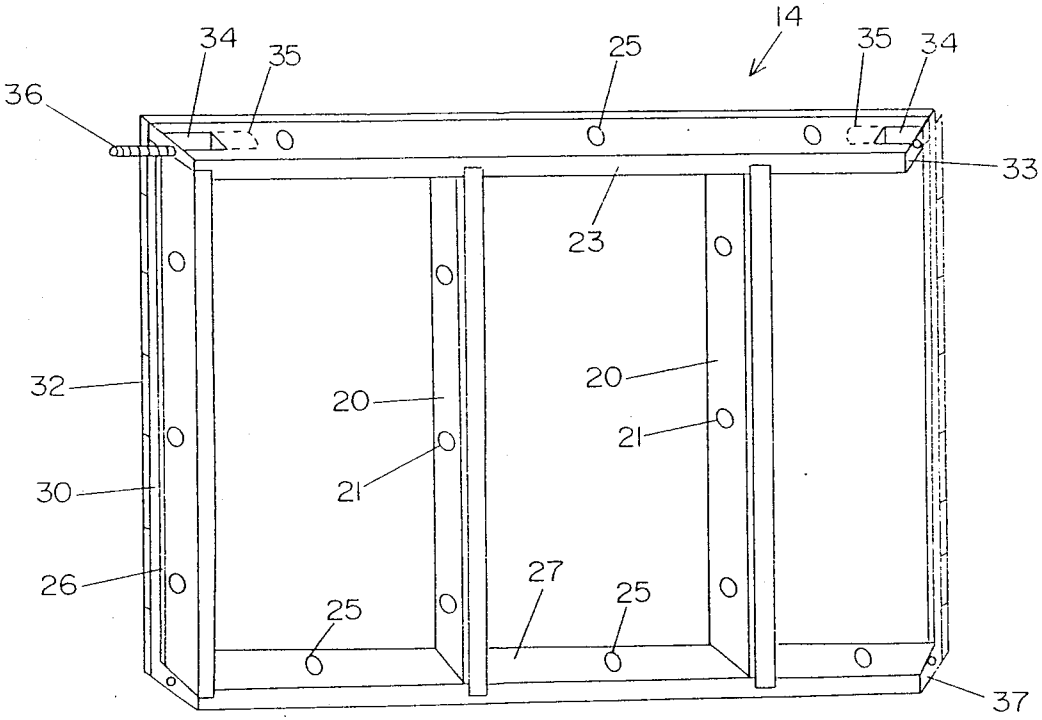
FIG. 2 is a perspective view of a finished wall section of the preferred embodiment.

FIG. 2 shows completed wall section 14 with the addition of decorative facing 32 onto the surface of concrete layer 30. This is accomplished quite simply by adding the decorative facing on top of the wet concrete before it sets. Decorative facing 32 can be any desired decoration such as thin brick facing. It can also be a particular surface finish upon the concrete itself, such as a stucco type finish or scribed lines to simulate stone.

FIG. 2 also shows the means for attaching wall sections 14 to each other to form longer sections or corners. To accomplish this, box structures 34 with concrete gripping rods 35 are placed within the cavities of support members 18 adjacent to the end of each section before pouring the concrete, and are encased within the concrete when it hardens. When the sections are later connected, this is done by inserting bolt 36 into box structure 34 and a nut into the matching box structure on the adjacent section and threading them tightly together. For corner connections beams 23 and 27 are formed with angled ends 33 and 37. This is accomplished quite simply by orienting one framing member 16 (FIG. 1) at an angle, which thereby causes concrete beams 23 and 27 to have ends with the same angle.

It should be apparent that the sequential layers of insulation sheet 26, concrete 30, and decorative facing 32 all may appear thicker in FIG. 2 than in actual wall sections, in order to depict the proper sequence of the layers. Wire mesh 28 is, of course, cast into concrete layer 30 and is therefore not visible in finished wall section 14.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the reinforcing material around which the concrete is poured can be standard concrete reinforcing rods or any reinforcing structure other than the wire mesh.

What is claimed as new and desired to be secured by Letters Patent of the United States is:

1. A wall structure comprising:

a base concrete beam located in essentially a horizontal plane;

vertical concrete studs, their lengths oriented vertically and their bottom ends interlocked with and spaced along the base stud, each concrete stud including an attachment strip attached to its edge which is on the inside surface of the wall structure and fasteners attached to and protruding from the edge which is on the outside surface of the wall structure;

a concrete top beam interlocked with the top ends of the vertical studs, located in an essentially horizontal plane;

rigid insulation attached to the outside edge of the concrete studs by being pierced by the fasteners attached to the edges of the concrete studs; and a layer of poured concrete attached to the surface formed by the insulation, the concrete enclosing the insulation and the fasteners.

2. The wall structure of claim 1, wherein the layer of concrete covers essentially the entire exterior wall surface.

3. The wall structure of claim 1 wherein the concrete studs include through holes across their thickness.

4. The wall structure of claim 1 wherein the layer of poured concrete is integral with the base concrete beam and the concrete top beam.

5. The wall structure of claim 1 further including through holes across the thickness of the top beam and the base beam.

6. The wall structure of claim 1 further including attachment means cast into the concrete top beam, for attaching several wall sections together.

7. The wall structure of claim 6 wherein the attachment means comprises a box structure which permits the insertion of a connecting means after construction of the wall section is completed to hold adjacent wall sections together.

8. The wall section of claim 1 wherein the base beam and the top beam are formed with angular ends to facilitate forming a corner by attaching two such angled ends together.

9. The wall section of claim 1 further including reinforcing means within the layer of poured concrete.

* * * * *